US012448862B1

(12) United States Patent
Olson

(10) Patent No.: US 12,448,862 B1
(45) Date of Patent: Oct. 21, 2025

(54) ALL IN ONE REMEDIAL TOOL

(71) Applicant: Brett Olson, Medicine Hat (CA)

(72) Inventor: Brett Olson, Medicine Hat (CA)

( * ) Notice: Subject to any disclaimer, the term of this patent is extended or adjusted under 35 U.S.C. 154(b) by 0 days.

(21) Appl. No.: 18/643,910

(22) Filed: Apr. 23, 2024

(51) Int. Cl.
*E21B 33/12* (2006.01)

(52) U.S. Cl.
CPC ..... *E21B 33/12* (2013.01)

(58) Field of Classification Search
CPC ..... E21B 33/12
See application file for complete search history.

(56) References Cited

U.S. PATENT DOCUMENTS 2,121,002 A * 6/1938 Baker ..... E21B 33/134 166/134
2,189,697 A * 2/1940 Baker ..... E21B 33/134 166/123
3,306,366 A * 2/1967 Muse ..... E21B 33/1294 166/334.1
3,375,874 A * 4/1968 Cherry ..... E21B 33/12 166/321
3,631,925 A * 1/1972 Nutter ..... E21B 23/06 166/134
3,631,926 A * 1/1972 Young ..... E21B 33/1293 166/134
3,631,927 A * 1/1972 Young ..... E21B 33/1293 166/134
3,831,677 A * 8/1974 Mullins ..... E21B 33/12 166/334.1
3,948,321 A * 4/1976 Owen ..... E21B 23/0414 166/207
4,049,055 A * 9/1977 Brown ..... E21B 43/045 166/212
4,178,992 A * 12/1979 Regan ..... E21B 23/02 166/117.6
4,349,071 A * 9/1982 Fish ..... E21B 34/12 166/137
4,390,065 A * 6/1983 Richardson ..... E21B 23/06 166/185
4,457,369 A * 7/1984 Henderson ..... E21B 33/1293 166/134
4,679,624 A * 7/1987 Harris ..... E21B 33/165 166/123
4,944,348 A * 7/1990 Whiteley ..... E21B 43/045 166/278
5,111,884 A * 5/1992 Striech ..... E21B 43/10 166/387
6,112,818 A * 9/2000 Campbell ..... E21B 43/105 166/207

(Continued)

*Primary Examiner* — Steven A Macdonald
(74) *Attorney, Agent, or Firm* — Husch Blackwell LLC

(57) ABSTRACT

A tool for remediating a well is provided. The tool can include a top end, the top end connectable to coiled tubing, a setting tool provided below the top end, the setting tool having a series of pistons, a retainer connectable below the setting tool, a setting sleeve, the setting sleeve displaceable downward by the setting tool to set the retainer in place in a well, a stinger connected to a piston rod of a final piston of the series of pistons, a release collet operative to disconnect the setting sleeve from the setting tool when the retainer is set, a lock down collet operative to lock the stinger in place below the setting sleeve when the retainer is set, and an inner passing running through the tool.

19 Claims, 14 Drawing Sheets

(56) References Cited

U.S. PATENT DOCUMENTS

| | | | | |
|---|---|---|---|---|
| 6,491,108 | B1 * | 12/2002 | Slup | E21B 33/1204 166/134 |
| 6,578,633 | B2 * | 6/2003 | Slup | E21B 33/1204 166/134 |
| 7,255,178 | B2 * | 8/2007 | Slup | E21B 33/134 166/387 |
| 9,528,341 | B2 * | 12/2016 | Slup | E21B 33/1216 |
| 10,612,342 | B2 * | 4/2020 | Abdollah | E21B 33/124 |
| 10,837,254 | B2 * | 11/2020 | Al-Mousa | E21B 47/117 |
| 2004/0065442 | A1 * | 4/2004 | Myerley | E21B 34/102 166/373 |
| 2008/0314591 | A1 * | 12/2008 | Hales | E21B 33/124 166/285 |
| 2011/0147014 | A1 * | 6/2011 | Chen | E21B 23/04 166/120 |
| 2018/0252069 | A1 * | 9/2018 | Abdollah | E21B 33/13 |

* cited by examiner

ALL IN ONE REMEDIAL TOOL

The present invention relates to a downhole tool to place a retainer in a well and then direct cement down the well.

BACKGROUND

When an oil or gas well is no longer needed, such as when it is dry and gas or oil can no longer be produced from the well, typically, the well must be permanently sealed and taken out of service. This is commonly known as abandonment.

To seal the well, one or more cement plugs are placed in the well to permanently seal off the well. To form a cement plug, it typically takes multiple trips downhole with different tools create the plug.

SUMMARY OF THE INVENTION

In an aspect, a tool for remediating a well is provided. The tool can include a top end, the top end connectable to coiled tubing, a setting tool provided below the top end, the setting tool having a series of pistons, a retainer connectable below the setting tool, a setting sleeve, the setting sleeve displaceable downward by the setting tool to set the retainer in place in a well, a stinger connected to a piston rod of a final piston of the series of pistons, a release collet operative to disconnect the setting sleeve from the setting tool when the retainer is set, a lock down collet operative to lock the stinger in place below the setting sleeve when the retainer is set, and an inner passing running through the tool. In a further aspect, the lock down collet of the tool can have a plurality of radially flexible spring fingers, and, pawls on lower ends of the plurality of radially flexible spring fingers.

In a further aspect, the release collet of the tool can have a plurality of radially flexible spring fingers and external ridges on upper ends of the plurality of radially flexible spring fingers. The external ridges of the plurality of radially flexible spring fingers of the release collet mate with corresponding internal threads on an inner surface of the setting sleeve.

In a further aspect, the tool can further have a perforating tool, the perforating tool positioned below the top end and above the setting tool.

DESCRIPTION OF THE DRAWINGS

A preferred embodiment of the present invention is described below with reference to the accompanying drawings, in which.

DETAILED DESCRIPTION OF THE ILLUSTRATED EMBODIMENTS

Figure 1:
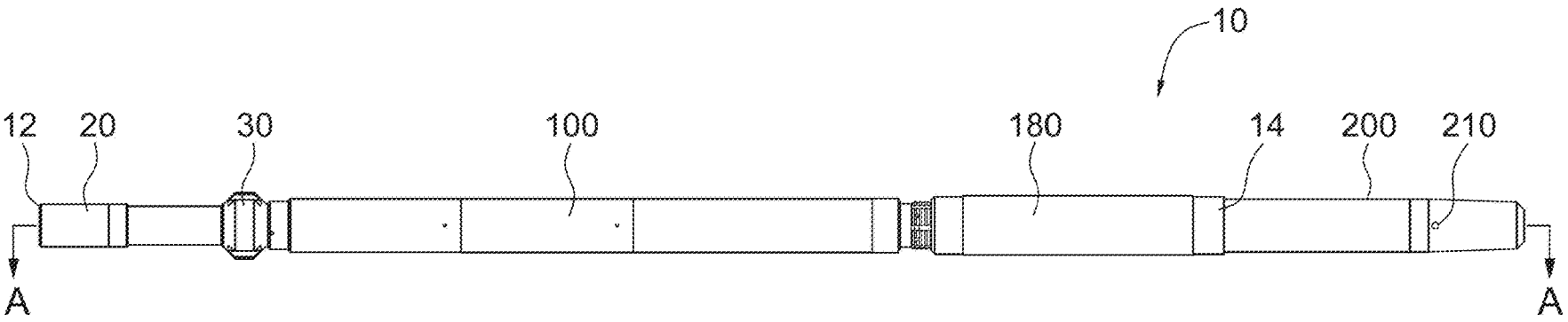
FIG. 1 is a side view of a tool in an non-stroked position before it is used to set a retainer in a well.

FIGS. 1-4 illustrate a tool 10 which can be used to install cement plugs in a well to abandon the well. The tool 10 can be used to set a retainer 200 in place in the well. The tool 10 can then use a stinger 140 to "stab" into the set retainer 200, opening a valve 212 in the retainer 200 to allow cement that has been pumped downhole, through the tool 10 and out the stinger 140 to be pumped through ports 210 exposed by the open valve 212 in the retainer 200 and spot cement into the well below the retainer 200. The tool 10 can then be pulled upwards, removing the stinger 140 from the retainer 200, closing the valve 212 in the retainer 200, to dump cement on top of the set retainer 200 through the stinger 140.

Figure 2:
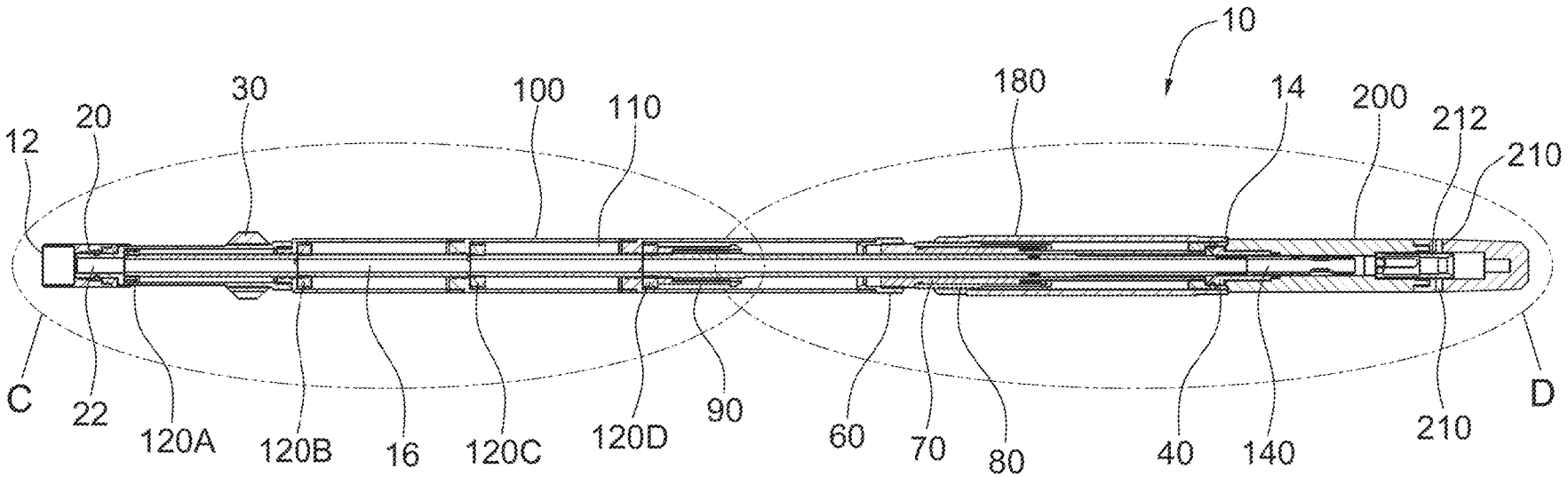
FIG. 2 is a cross-sectional view of the tool along sectional line A-A of FIG. 1.
Figure 3:
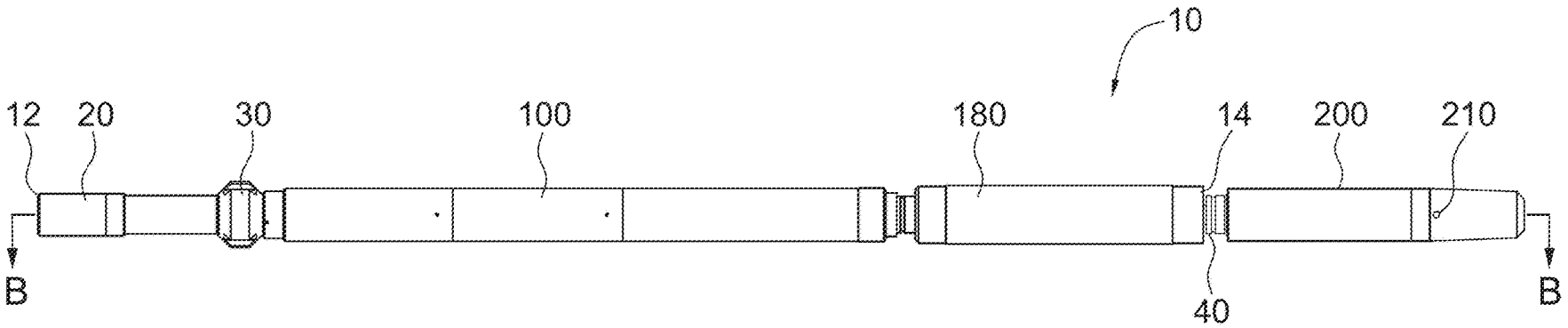
FIG. 3 is a side view of the tool of FIG. 1 in a stroked position where the retainer has been set.
Figure 4:
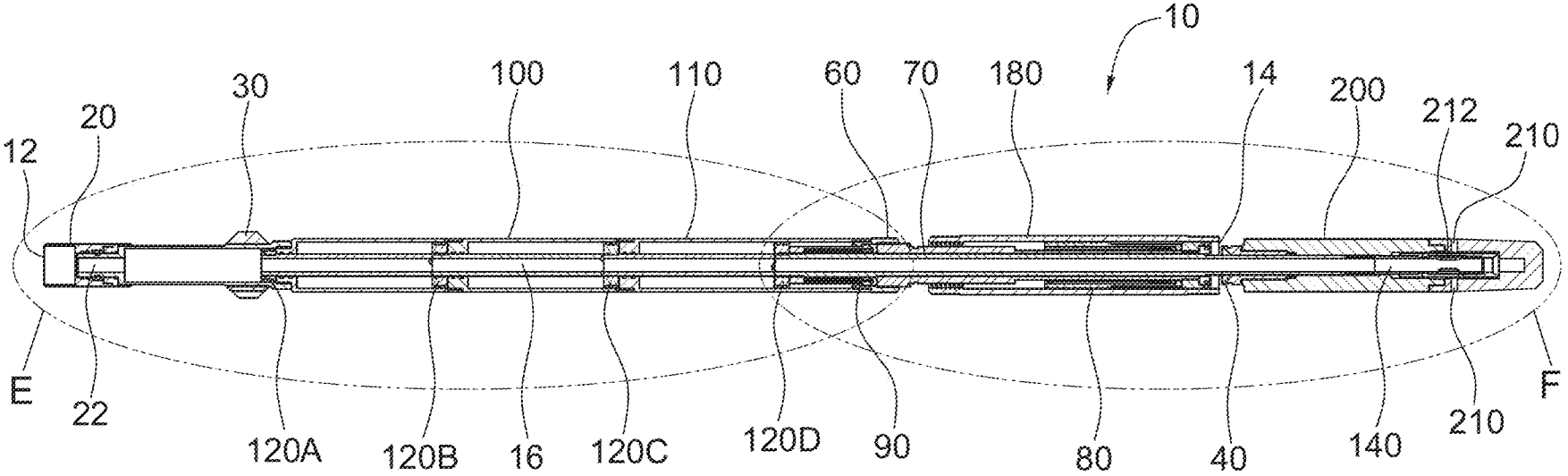
FIG. 4 is a cross-sectional view of the tool along sectional line B-B of FIG. 3.

The tool 10 can have a top end 12 and a bottom end 14. The retainer 200 can be attached at the bottom end 14 of the tool 10. The tool 10 can include: a connector sub 20; optionally, a centralizer 30; a setting tool 100; a setting sleeve 180; and a sheer collar 40. Referring to FIGS. 2 and 4, the tool 10 can also include: an inner passage 16; a series of pistons 120A, 120B, 120C, and 120D in the setting tool 100; a release collet 80; a lock down collect 90; a bottom cap 60; a drive sub 70; and, the stinger 140.

The connector sub 20 can be provided at the top end 12 of the tool 10 and be connectable to coiled tubing so that the tool 10 can be connected to coiled tubing. An inner passage 22 can run through the connection sub 20 forming a portion of the inner passage 16 that runs through the tool 10.

The centralizer 30 can be provided on this connector sub 20 to centralize the tool 10 in a well.

The inner passage 16 can be oriented to pass substantially axially through the tool 10, from an inlet at the top end 12 of the tool 14 through to the bottom end 14 and through the stinger 140.

Figure 5:
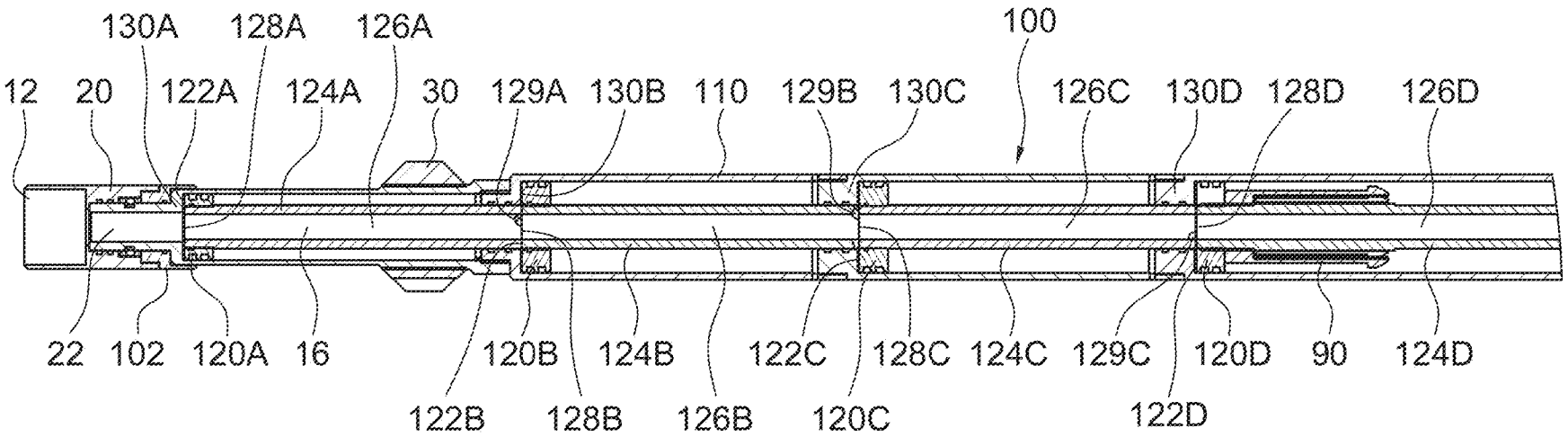
FIG. 5 is a detailed cross-sectional view of section C shown in FIG. 2 of an unstroked setting tool.
Figure 6:
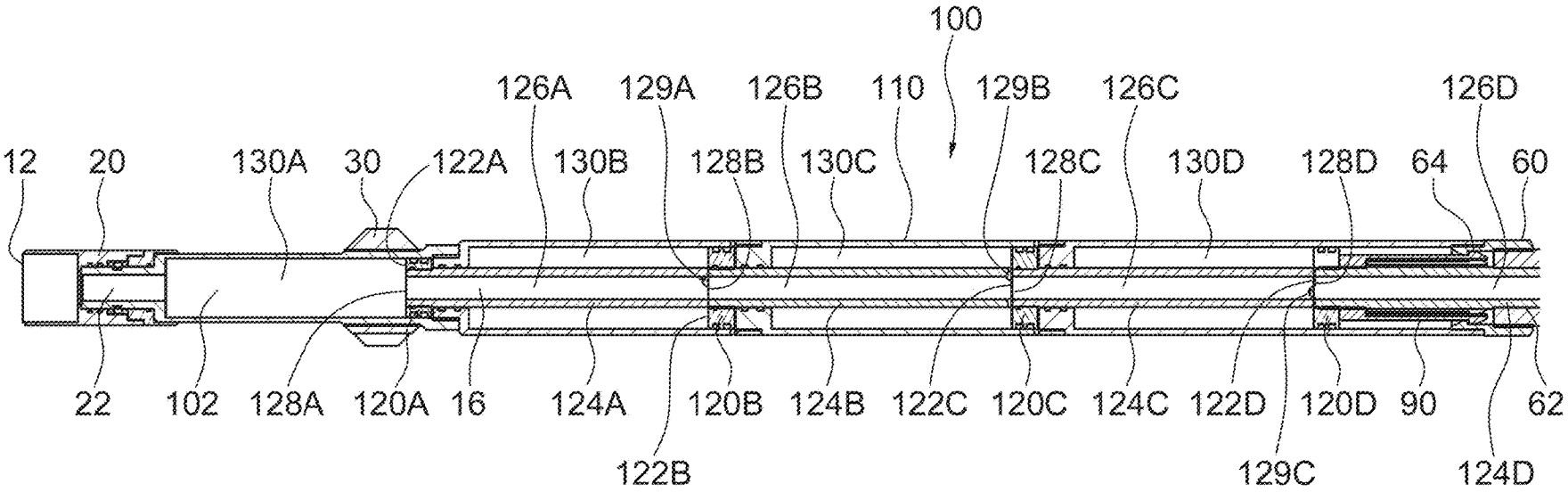
FIG. 6 is a detailed cross-sectional view of section E shown in FIG. 4 of the stroked setting tool.

The setting tool 100 can be provided connected below the connector sub 20 and the retainer 200 can be connected below the setting tool 100 by the shear collar 40. The setting tool 100 can be used to set the retainer 200 in position in a well. Referring to FIGS. 5 and 6, the setting tool 100 can have: an upper end 102; a lower end 104; a series of pistons provided in piston chambers; and, an outer wall 110. The setting sleeve 180 can be moved by the setting tool 100 to set the retainer 200 in the well.

The series of piston can include a first piston 120A, additional pistons 120B, 120C and a final piston 120D. However, fewer or more pistons could be provided. The series of pistons 120A, 120B, 120C, and 120D can be provided inside the outer wall 110 of the setting tool 100 and create the force needed on the setting sleeve 180 to set the retainer 200 in place in the well and then to shear the shear collar 40 to separate the retainer 200 from the tool 10, leaving the retainer 200 set in place in the well.

The first piston 120A can be provided in a first piston chamber 130A, each additional piston 120B, 120C can be provided in an additional piston chamber 130B, 130C and the final piston 120D can be provided in a final piston chamber 130D.

The first piston 120A can have a piston head 122A and a piston rod 124A extending downwards from the piston head 122A. A passage 126A can be provided running through the piston rod 124A, forming part of the inner passage 16 of the tool 10, and an aperture 128A can be provided in the piston head 122A leading into the passage 126A in the piston rod 124A. At least one aperture 129A can also be provided in a side of the piston rod 124A, placing the passage 126A in the piston rod 124A in fluid communication with the additional piston chamber 130B below the first piston 120A.

The first piston 120A can be provided in the first additional piston chamber 130B. As the first piston 120A is displaced downward, the first additional piston 120B will also be displaced downwards in the first additional piston chamber 130B and a space is formed above the first additional piston 120B, defined by the annulus formed between the piston rod 124A of the first piston 120A and the inner surface of the outer wall 110 of the setting tool 100. The at least one aperture 129A in the piston rod 124A of the first piston 120A allows pressurized fluid passing through the passage 126A in the piston rod 124A to enter the piston chamber 130B of the first additional piston 120B.

In one aspect, the aperture 129A can be in side of the piston rod 124A at a bottom end of the piston rod 124A so that the aperture 129A is in fluid communication with the additional piston chamber 130B below the first piston 120A even when the first piston 120A is at a top of its stroke and liquid can exit the passage 126A in the piston rod 124A even when the bottom of the piston rod 124A is pressed against a top of the additional piston 120B below it.

The additional piston 120B can have a piston head 122B, and a piston rod 124B extending downwards from the piston head 122B. A passage 126B can be provided running through the piston rod 124B of each additional piston 120B, forming part of the inner passage 16 of the tool 10, and an aperture 128B can be provided in the piston head 122B leading into the passage 126B in the piston rod 124B. At least one aperture 129B can also be provided in a side of the piston rod 124B, placing the passage 126B in the piston rod 124B in fluid communication with the additional piston chamber 130C below the additional piston 120B.

A space above the additional piston 120C and below the first additional piston 120B can be formed by the annulus between the piston rod 124B of the preceding additional piston 120B and the inner surface of the outer wall 110 of the setting tool 100. The at least one aperture 129B allows pressurized fluid passing through the passage 126B in the piston rod 124B of the additional piston 120B to enter this space and act on the additional piston 120C.

The additional piston 130C can also have a piston head 122C, and a piston rod 124C extending downwards from the piston head 122C. A passage 126C can be provided running through the piston rod 124C of the additional piston 120C, forming part of the inner passage 16 of the tool 10, and an aperture 128C can be provided in the piston head 122C leading into the passage 126C in the piston rod 124C. At least one aperture 129C can also be provided in a side of the piston rod 124C, placing the passage 126C in the piston rod 124C in fluid communication with the final piston chamber 130D below the additional piston 120C and above the final piston 120D.

The final piston 120D can also have a piston head 122D, and a piston rod 124D extending downwards from the piston head 122D. A passage 126D can be provided running through the piston rod 124D, forming part of the inner passage 16 of the tool 10, and an aperture 128D can be provided in the piston head 122D leading into the passage 126D in the piston rod 124D. The piston rod 124D of the final piston 120D, unlike the piston rods 124B, 124C of the additional pistons 120B, 120C or the piston rod 124A of the first piston 120A may not have an aperture provided in it since the piston rod 124D of the final piston 120D is not positioned passing through a piston chamber.

The stinger 140 can be connected to the bottom end of the piston rod 124D of the final piston 120D.

The upper end 102 of the setting tool 100 can be connected to connector sub 20 so that pressurized fluid, such as water, that flows down the coiled tubing and through the passage 22 in the connector sub 20 enters the setting tool 100 at the upper end 102 of the setting tool 100. Before the setting tool 100 is stoked, the pistons 120A, 120B, 120C and 120D will be in their top positions as shown in FIG. 5. When pressurized fluid enters the upper end 102 of the setting tool 100, some of this pressurized fluid presses against the piston head 122A of the first piston 120A and some of this pressurized fluid will flow through the aperture 128A in the piston head 122A of the first piston 120A and through the passage 126A in the piston rod 124A of the first piston 120A. The pressurized fluid that is flowing through the passage 126A in the piston rod 124A of the first piston 120A will flow down the passage 126A towards the first additional piston 120B where some of the pressurized fluid will exit the passage 126A in the piston rod 124A through the aperture 129A, entering the first additional piston chamber 130B above the first additional piston 120B and applying pressure to the piston head 122B of the first additional piston 120B and some of this pressurize fluid will continue through the aperture 128B in the piston head 122B of the first additional piston 120B and into the passage 126B in the piston rod 124B of the first additional piston 120B extending below the piston head 122B of the first additional piston 120B.

For the additional piston 120C, some of the pressurized fluid flowing through the inner passage 16 formed from the passages 126A, 126B in the piston rods 124A, 124B will exit the piston rods 124A, 124B through the apertures 129A, 129B in the piston rods 124A, 124B and into the piston chamber 130C the additional piston 120C is provided in, above the additional piston 120C, and some of the pressurized fluid will continue to flow downward through the inner passage 16 formed by the passages 126B, 126C in the piston rods 124B, 124C.

For the final piston 120D, some of the pressurized fluid flowing through the inner passage 16 formed from the passages 126A, 126B, 126C in the piston rods 124A, 124B, 126C will exit the piston rods 124C through the apertures 129C and into the piston chamber 130D above the final piston 130C, and some of the pressurized fluid will continue to flow downward through the inner passage 16 formed by the passage 126D in the piston rod 124D.

In this manner, some of the pressurized fluid passing through the inner passage 16 of the tool 10 will flow into the first piston chamber 130A, the additional piston chambers 130B, 130C and the final piston chamber 130D displacing first piston 120A, the additional pistons 120B, 120C and the final piston 120D downwards as more and more pressurized fluid builds up against the piston heads 122A, 122B, 122C, 122D. The displacement of the series of pistons 122A, 122B, 122C, 122D downwards in the tool 10 will cause the setting sleeve 180 to be displaced downwards, pressing against the retainer 200 and setting the retainer 200 in place in a well. Continued downward displacement of the series of pistons 122A, 122B, 122C, 122D and the setting sleeve 180 will shear the shear collar 40, separating the retainer 200 from the setting tool 100.

FIG. 6 illustrates the setting tool 100 in the fully stroked position with the pistons 120A, 120B, 120C, and 120D at the bottom of their displacement.

Figure 7:
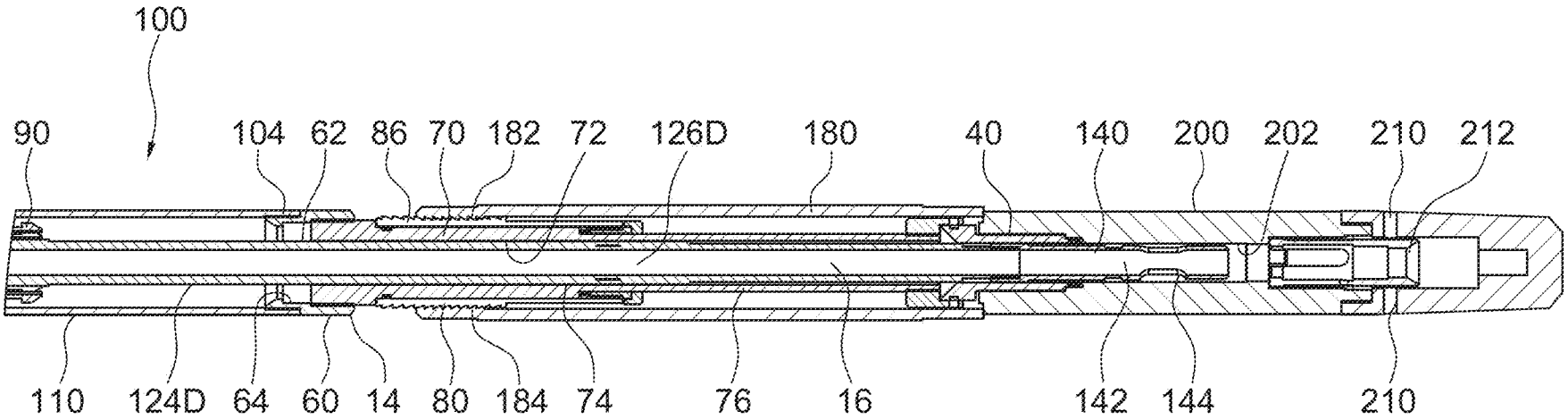
FIG. 7 is a detailed cross-sectional view of section D shown in FIG. 2 of an unstroked retainer.
Figure 8:
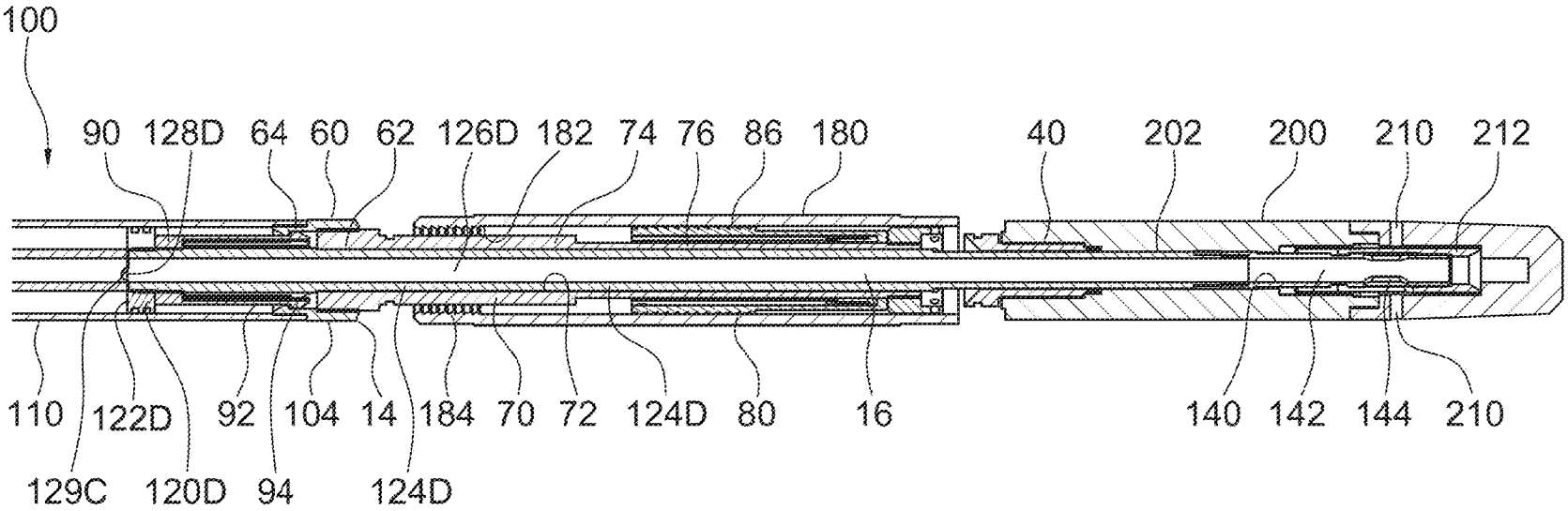
FIG. 8 is a detailed cross-sectional view of section F shown in FIG. 4 of an stroked retainer.

Referring to FIGS. 7 and 8, the bottom cap 60 can be provided in the lower end 104 of the setting tool 100. An aperture 62 can be provided in the bottom cap 60 so that the piston rod 124D of the final piston 120D can slide vertically upwards and downwards through this aperture 62 in the bottom cap 60. The bottom cap 60 can have a retention groove 64 in an inner surface of the bottom cap 60 for receiving the lock down collet 90.

The drive sub 70 can be connected to the lower end 104 of the setting tool 100, below the bottom cap 60, and the drive sub 70 can extend downwards inside the setting sleeve 180. An aperture 72 can be provided in the drive sub 70 so that the piston rod 124D of the final piston 120D can extend through this aperture 72 in the drive sub 70.

The drive sub 70 can have a first profile 74 and a second profile 76 with the first profile 74 being larger or "thicker" than the second profile 76.

The stinger 140 can have a tubular body with an inner passage 142, forming part of the inner passage 16 running through the tool 10, passing generally axially through the interior of the stinger 140. An outlet port 144 can be provided near a bottom end of the stinger 140 and passing into the inner passage 142. The stinger 140 can be connected to a bottom end of the piston rod 124C of the final piston 120C.

Figure 9:
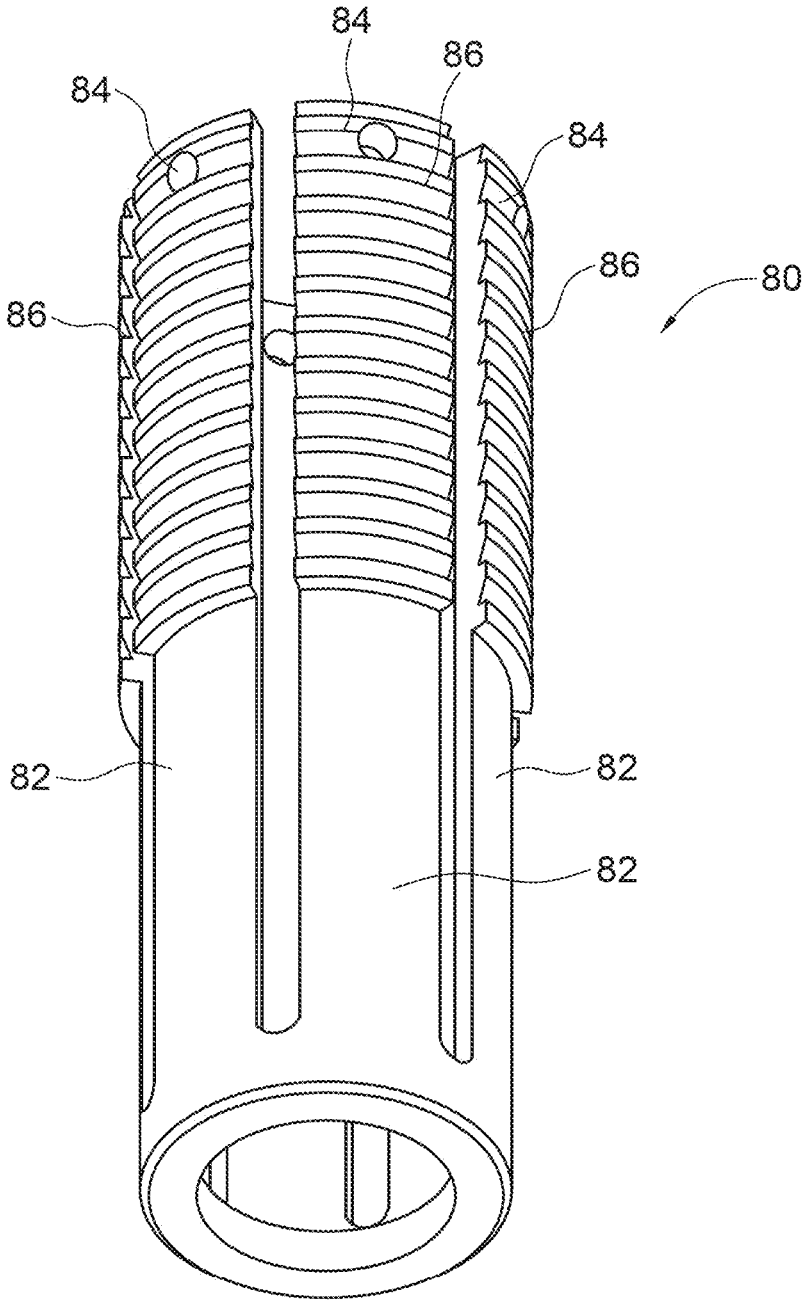
FIG. 9 is a perspective view of a release collet.

The release collet 80 can be used to "disconnect" the setting sleeve 180 from the rest of the tool 10 when the tool 10 is fully stroked so that the setting sleeve 180 can "float" vertically up and down relative to the tool 10 after the retainer 200 has been set in place in the well. Referring to FIG. 9, the release collet 80 can have radially flexible spring fingers 82 with external ridges or threads 86 on upper ends 84 of the fingers 82 for mating with corresponding internal threads 184 on the on the upper end inner surface 182 of the setting sleeve 180.

Originally, to set up the tool 10 so it can be run down a well, the release collet 80 can be positioned so that it is inserted between an outer surface of the drive sub 70, in the first profile 74, and the inside surface 182 of the setting sleeve 180, as shown in FIG. 7. The thickness of the first profile 74 of the drive sub 70 will leave a smaller space between the inner surface 182 of the setting sleeve 180 and an outer surface of the drive sub 70 which will force the external threads 86 of the release collet 80 into the corresponding internal threads 184 of the setting sleeve 180 and "locking" the setting sleeve 180 to the drive sub 70.

As the piston rod 124D of the final piston 120D is displaced, it will also displace the setting sleeve 180 downwards, which will cause the top end of the setting sleeve 180, where the internal threads 184 of the setting sleeve 180 are engaged with the external threads 86 of the release collet 80, to drag the release collet 80 downwards relative to the drive sub 70, which is connected to the lower end 104 of the setting tool 100. When the fingers 82 of the release collect 80 are provided in the first profile 74 of the drive sub 70, the first profile 74 is thick enough that there is little clearance between the external threads 86 of the release collect 80 and the internal threads 184 of the setting sleeve 180, keeping the external threads 86 of the release collect 80 in the internal threads 184 of the setting sleeve 180 and the release collet 80 and the setting sleeve 180 locked together. However, when the release collect 80 is dragged downwards along the drive sub 70 far enough that the release collect 80 is positioned adjacent to the second profile 76, the thinner second profile 76 provides more clearance between the drive sub 70 and the internal threads 184 of the setting sleeve 180, allowing the fingers 82 of the release collet 80 to flex inwards and the external threads 86 of the release collect 80 to move out of the internal ridges 184 of the setting sleeve 180. This will release or "unlock" the release collet 80 from the setting sleeve 180 and allow the release collet 80 to move vertically independently from the setting sleeve 180, unlocking the setting sleeve 180 and allowing the setting sleeve 180 to move vertically relative to the piston rod 124D of the final piston 120D, as shown in FIG. 8. By making the distance the release collet 80 has to be displacement downwards to reach the second profile 76 of the drive sub 70 greater than the distance the setting sleeve 180 has to be displaced to set the retainer 200 and sheer the sheer collar 40, the release collet 80 will "unlock" the setting sleeve 180 after the retainer 200 has been set in place in the well.

The lock down collet 90 can be used to "lock" the piston rod 124D of the final piston 120D and therefore the stinger 140 in place relative to the setting tool 100, with the stinger 140 extending a set distance below the bottom of the bottom cap 60 and the lock down collet 90 preventing the piston rod 124D of the final piston 120D and the stinger 140 from moving upwards and/or downwards relative to the rest of the tool 10.

Figure 10:
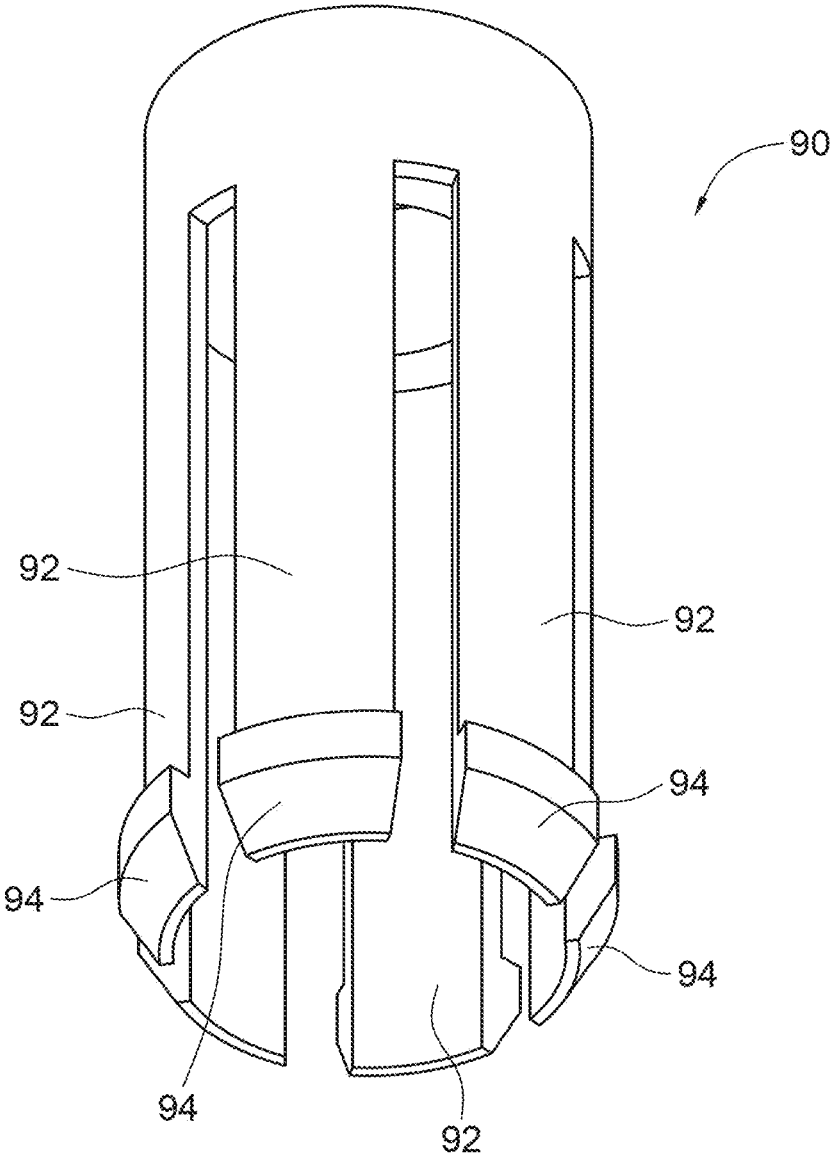
FIG. 10 is a perspective view of a lock down collet.

Referring to FIG. 10, the lock down collect 90 can have radially flexible spring fingers 92 with pawls 94 on the lower ends of the fingers 92 that correspond with the retention groove 64 in the inner surface of the bottom cap 60.

Referring to FIG. 8, the lock down collet 90 can be positioned below the piston head 122D of the final piston 120D so that the downward movement of the final piston 120C will also result in downward motion of the lock down collet 90.

Originally, the final piston 120D and the lock down collet 90 are positioned in the final piston chamber 130D some distance above the bottom cap 60, as shown in FIG. 2, so that the entire lock down collet 90 and particularly the pawls 94 on the spring fingers 92 of the lock down collet 90 will be above the bottom cap 60.

As the final piston 120D is displaced downwards, the lock down collet 90 will be displaced downwards with the final piston 120D towards the bottom cap 60. Eventually, when the final piston 120D has been displaced enough, the lock down collet 90 will reach a bottom of its travel and the pawls 94 on the spring fingers 92 of the lock down collet 90 will be forced into the retention groove 64 in the inner surface of the bottom cap 60, as shown in FIG. 8. With the pawls 94 on the spring fingers 92 of the lock down collet 90 "locked" in place in the retention groove 64 in the inner surface of the bottom cap 60, the piston head 122D of the last piston 120D, which is attached to the lock down collet 90, and therefore the piston rod 124D, attached to the piston head 122D, and the stinger 140 will be locked in placed relative to the rest of the tool 10, preventing the piston rod 124D of the final piston 120D and the stinger 140 attached to the end of the piston rod 124D from moving upwards and downwards relative to the setting tool 100.

The retainer 200 can have an internal passage 202 sized to accept the stinger 140. The retainer 200 can have a port 210 which can be can be substantially aligned with the outlet port 144 of the stinger 140 when the stinger 140 is inserted into the internal passage 202 of the retainer 200. A valve 212 in the retainer 200 can be engaged by the stinger 140 when the stinger 140 is inserted into the internal passage 202 to open up the port 210 in the retainer 200 to allow fluid, such as cement, through the port 210 and below the retainer 200 where it is set in place in the well. This allows the stinger 140 of the tool 10, after it has been locked in place by the lock down collet 90, to be "stung in" to the retainer 200 by forcing the stinger 140 into the internal passage 202 of the retainer 200 and engaging the valve 212 to open the port 210 so that cement that is pumped down the well through the coiled tubing, through the internal passage 15 of the tool 10, and through the inner passage 142 of the stinger 140, can be directed out through the outlet port 140 of the stinger 140, through the opened port 210 in the retainer 200 and out into the well below the retainer 200.

Referring to FIGS. 1-10, in operation, the tool 10 can be lowered down to a desired depth where it is desired to set the retainer 200. With the tool 10 and the retainer 200 at the desired depth in the well, pressurized fluid, such as water, can be pumped down the coiled tubing and into the tool 10 and the inner passage 16 of the tool 10. This pressurized fluid can pass through the connector sub 20, through the inner passage 22, and into the setting tool 100.

In the setting tool 100, the pressurized fluid can place a force against the pistons 120A, 120B, 120C, 120D and displace these pistons 120A, 120B, 120C, 120D downwards. This downward displacement of the pistons 120A, 120B, 120C, 120D will force the piston rod 124D of the final piston 120D downwards, thereby forcing the setting sleeve 180 downwards, against the top of the retainer 200. As the setting sleeve 180 is forced against the retainer 200, the retainer 200 will be set in place in the well. Continued downwards displacement of the piston rod 124D and the setting sleeve 18D will shear the shear collar 40, separating the retainer 200 from the bottom end 14 of the tool 10.

When the retainer 200 is separated from the bottom end 14 of the tool 10, the release collet 90 can "disconnect" the setting sleeve 180, allowing the setting sleeve 180 to "float" vertically up and down relative to the tool 10. As the piston rod 124D of the final piston 120D is displaced, forcing the setting sleeve 180 downwards against the retainer 200, the release collet 80 will be dragged downwards relative to the drive sub 70. When the retainer 200 is set and the shear collar 40 sheared, the release collet 80 will be dragged to the second profile 76 of the drive sub 70 and the external threads 86 of the release collect 80 will be released from the internal threads 184 of the setting sleeve 180, releasing the setting sleeve 180 to move freely vertically relative to the rest of the tool 10.

The lock down collet 90 can "lock" the piston rod 124D of the final piston 120D and therefore the stinger 140 in place relative to the setting tool 100, with the stinger 140 extending a set distance below the bottom end 14 of the tool 10. As the final piston 120D is displaced downwards, the lock down collet 90 will be displaced downwards with the final piston 120D towards the bottom cap 60. Eventually, when the final piston 120D has been displaced enough, the lock down collet 90 will reach a bottom of its travel and the pawls 94 on the spring fingers 92 of the lock down collet 90 will be forced into the retention groove 64 in the inner surface of the bottom cap 60, locking the piston rod 124D of the final piston 120D and therefore the stinger 140 in place.

With the stinger 140 locked in place extending below a bottom end 14 of the tool 10, the tool 10 can be lowered down the well so that the stinger 140 is "stung" into the retainer 200 to open the valve 212 in the retainer 200. The stinger 140 can be inserted into the internal passage 202 of the retainer 200, pushing against the valve 212 and opening the port 210.

With the valve 212 opened, cement that has been pumped down the coiled tubing and through the inner passage 16 of the tool 10 can flow out the outlet port 144 of the stinger 140 and through the port 210 in the retainer 200 below the retainer 200 to cement the well below the retainer 200.

When a desired amount of cement has been dumped below the retainer 200, the tool 10 can be pulled back up the well, pulling the stinger 14 out of the internal passage 202 of the retainer 200 and closing the valve 212 in the retainer 200.

More cement can be pumped down the coiled tubing and through the inner passage 16 of the tool 10 to be dumped onto of the retainer 200 forming a cement seal above the retainer 200 as well, if desired.

Once the desired amount of cement has been placed on the retainer 200, the tool 10 can be pulled out of the well and then set up to be reused elsewhere.

The tool 10 can also be used to repair cement jobs in the well, rather than just setting plugs.

Figure 11:
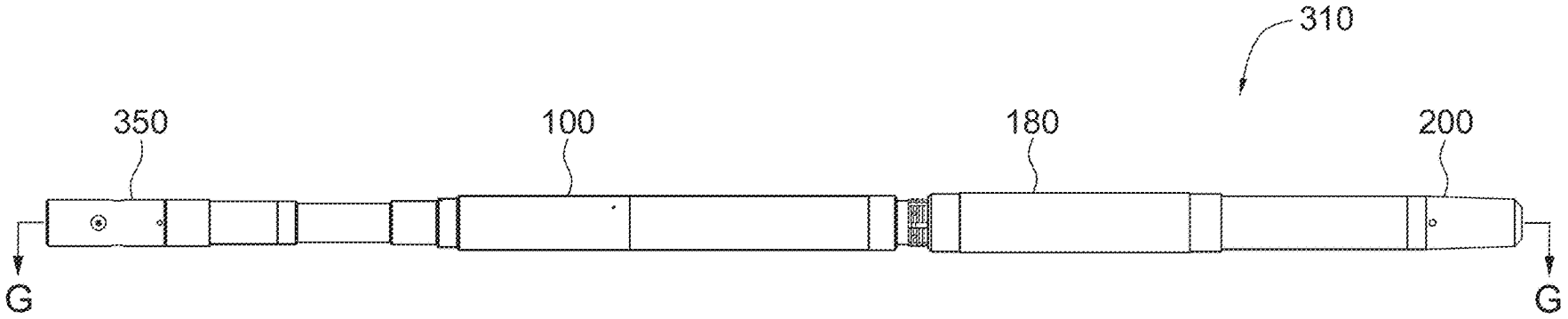
FIG. 11 is a side view of another tool that includes a perforation tool.
Figure 12:
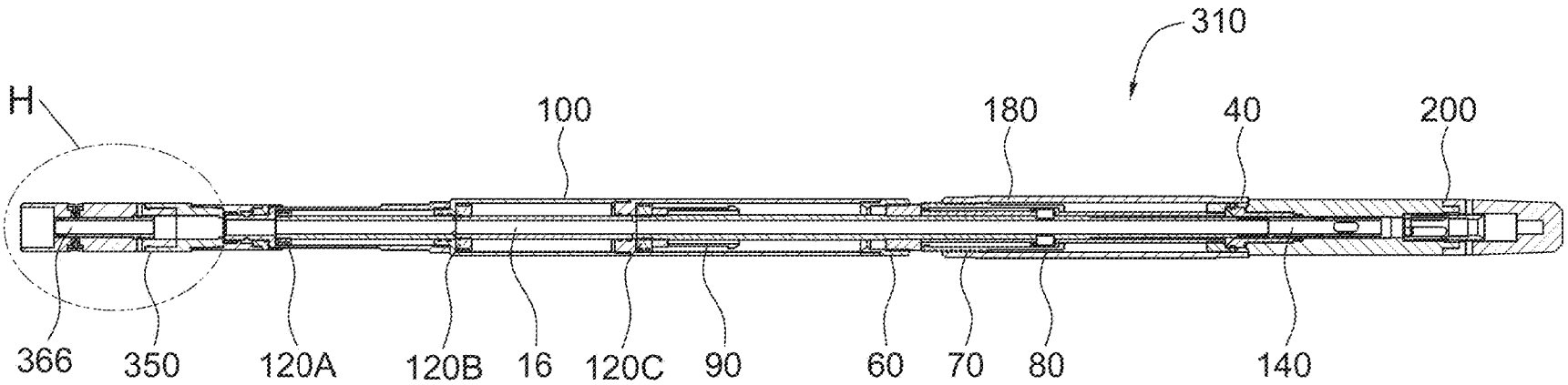
FIG. 12 is a cross-sectional view of the tool along sectional line G-G of FIG. 11.

Referring to FIGS. 11 and 12, a tool 310 is shown that includes a perforation tool 350. The tool 310 can be similar to the tool 10 and can be used to set a retainer 200 in place in a well and then use a then use a stinger 140 to "stab" into the set retainer 200, opening a valve in the retainer 200 to allow cement that has been pumped downhole, through the tool 310 and out the stinger 140 to be pumped through the retainer 200 and spot cement into the well below the retainer 200. The tool 10 can then be pulled upwards, removing the stinger 140 from the retainer 200, closing the valve in the retainer 200, in order to dump cement on top of the set retainer 200.

Like tool 10, tool 310 can have a setting tool 100; a setting sleeve 180; and a sheer collar 40. Referring to FIG. 12, the tool 310 can also include: an inner passage 16; a series of pistons 120A, 120B, and 120 in the setting tool 100; a release collet 80; a lock down collect 90; a bottom cap 60; a drive sub 70; and, the stinger 140.

Figure 13:
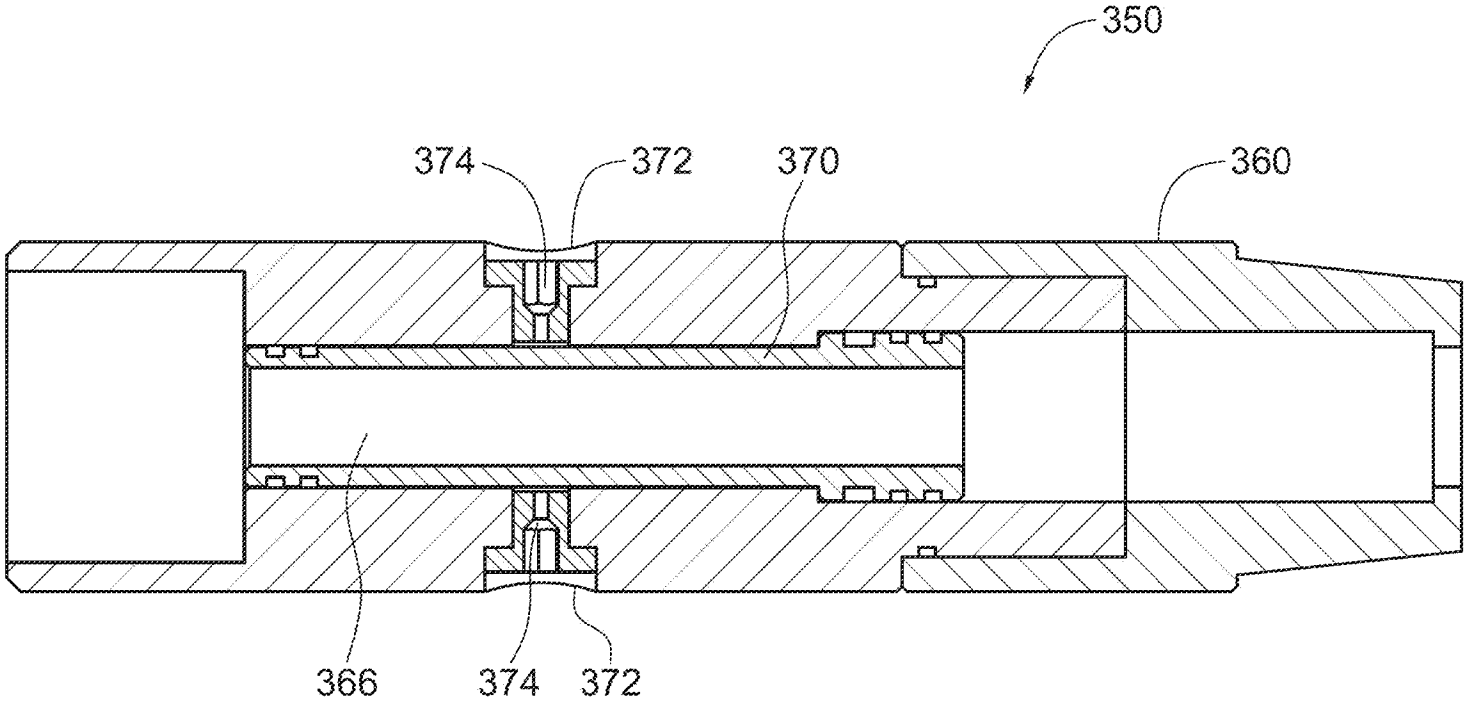
FIG. 13 is a detailed cross-sectional view of section H shown in FIG. 12 of the perforation tool in an unset position.

Referring to FIG. 13, the perforating tool 350 is shown in its unset position before it is used to perforate a well. The perforating tool 350 can include a body 360, an inner passage 366, a sleeve valve 370, and an outlets 372.

The inner passage 366 can run through the body 360, generally axially in the body 360. This inner passage 366 can form part of the passage 16 in the tool 310.

The sleeve valve 370, in its unset position, will cover the outlets 372 passing through the body 360 preventing fluid passing through the inner passage 366 of the perforating tool 350 from exiting the inner passage 366 and out the outlets 372. Referring to FIG. 12, the inner passage 366 of the perforating tool 350 forms part of the inner passage 16 of the tool 310 when the perforating tool 350 is in its set position and fluid can pass through the inner passage 366 of the perforating tool 350 and then through the inner passage 16 of the tool 310 when the perforating tool 360 is in the unset position.

Figure 14:
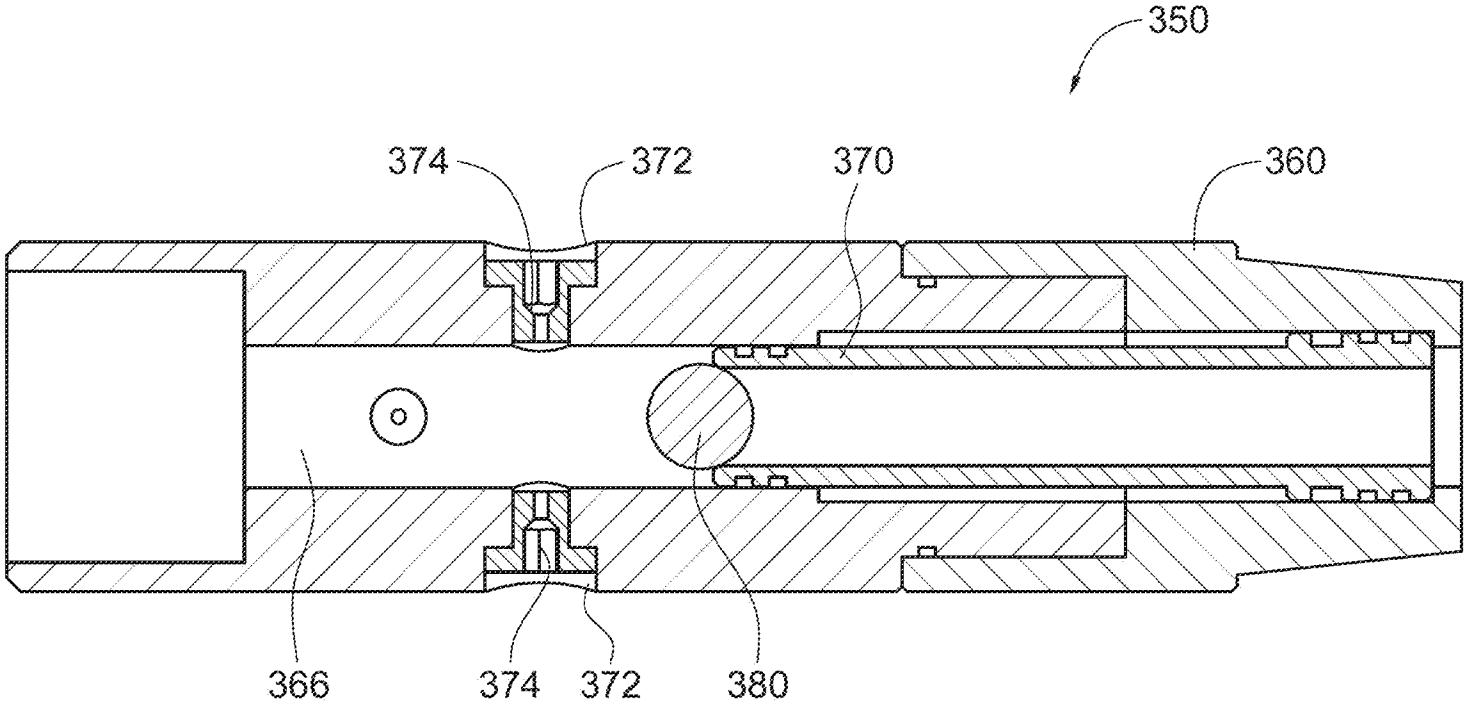
FIG. 14 is a cross-section view of the perforation tool of FIG. 13 is a set position.

Referring to FIG. 14, the perforating tool 350 is shown in a set position. A ball 380 can be run down coiled tubing connected to the tool 310 to be seated in a top of the sleeve valve 370. The diameter of the ball 380 can be greater than the inner diameter of the sleeve valve 370 so that the ball 380 seats in a top of the sleeve valve 370 when the ball reaches the seat valve 370 in the perforating tool 350. As pressurized fluid is continued to be pumped down the coiled tubing connected to the tool 310, the continued pressure on the ball 380 after it reaches and seats in a top of the sleeve valve 370 can shift the sleeve valve 370 downwards from the unset position shown in FIG. 13 to the set position shown in FIG. 14, uncovering the outlets 372 and placing the outlets 372 in fluid communication with the inner passage 366 of perforating tool 350.

The sleeve valve 370 may initially be kept in place with shear screws that can shear when the ball 380 places enough downward force on the sleeve valve 370, causing the sleeve valve 370 to start shifting downwards.

In the set position shown in FIG. 14, an abrasive slurry, such as a water/sand slurry, can be pumped down the coiled tubing and into the tool 310. In the tool 310, it will first pass through the inner passage 366 in the perforating tool 350. However, with the ball 380 seated in place in the top of the sleeve valve 370, the slurry will be blocked from continuing to travel down the inner passage 366 by the ball 380. With the sleeve valve 370 moved downward, exposing the outlets 372, the slurry can exit out the outlets 372.

By having each outlet 372 contain a nozzle 374, the pressure of the slurry exiting the perforating tool 350 by the outlets 372 through the nozzles 374 can be increased.

This abrasive slurry exiting the perforating tool 350 can then hit the casing in the well and eventually bore through the casing to perforate the well.

This perforation of the casing in the well by the perforation tool 350 allows an operator to remove the tool 310 from the well to remove the ball 380 and then lower the tool 310 downhole once again to route cement into the portion of the well. The perforations made in the casing will allow this cement to pass through these perforations and cement outside the casing to block passages that may have formed between the outside of the casing and the formation.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A tool for remediating a well, the tool comprising:
- a top end, the top end connectable to coiled tubing;
- a setting tool provided below the top end, the setting tool having a series of pistons;
- a retainer connectable below the setting tool;
- a setting sleeve, the setting sleeve displaceable downward by the setting tool to set the retainer in place in a well;
- a stinger connected to a piston rod of a final piston of the series of pistons;
- a release collet operative to disconnect the setting sleeve from the setting tool when the retainer is set;
- a lock down collet operative to lock the stinger in place below the setting sleeve when the retainer is set; and
- an inner passing running through the tool.

2. The tool of claim 1 wherein the lock down collet comprises:
- a plurality of radially flexible spring fingers; and,
- pawls on lower ends of the plurality of radially flexible spring fingers.

3. The tool of claim 2 further comprising:
- a bottom cap provided in the lower end of the setting tool, the bottom cap having an aperture the piston rod of the final piston can pass through, and a retention groove for receiving the pawls on the lock down collet to lock the stinger in place.

4. The tool of claim 3 wherein the retention groove in the bottom cap is in an inner surface of the bottom cap.

5. The tool of claim 3 wherein the lock down collet is positioned below the piston head of the final piston.

6. The tool of claim 1 wherein the release collet comprises:
- a plurality of radially flexible spring fingers; and
- external ridges on upper ends of the plurality of radially flexible spring fingers,
- and wherein the external ridges of the plurality of radially flexible spring fingers of the release collet is configured to mate with corresponding internal threads on an inner surface of the setting sleeve.

7. The tool of claim 6 further comprising:
- a drive sub connected to the lower end of the setting tool and extending inside the setting sleeve, an aperture provided in the drive sub so that the piston rod of the final piston can extend through the aperture in the drive sub, the drive sub having a first profile and a second profile, the first profile being larger than the second profile,
- and wherein release collect is positioned adjacent to the first profile of the drive sub and moves to a position adjacent to the second profile of the drive sub to disconnect the setting sleeve from the setting tool.

8. The tool of claim 1 wherein the stinger has a tubular body, an inner passage, and an outlet port leading into the inner passage, the inner passage of the stinger forming a portion of the inner passage running through the tool.

9. The tool of claim 1 further comprising a shear collar connected between the setting tool and the retainer.

10. The tool of claim 1 further comprising a connector sub having the top and connectable to coiled tubing, the connector sub having an inner passage running generally axially through the connector sub, the inner passage of the connector sub forming a portion of the inner passage passing running through the tool.

11. The tool of claim 1 wherein the series of pistons of the setting tool comprises:
- a first piston;
- at least one additional piston positioned downstream from the first piston; and
- the final piston.

12. The tool of claim 11 wherein the first piston has a piston head, a piston rod extending downwards from the head, a passage running through the piston rod, and an aperture passing through the piston head and into the passage in the piston rod.

13. The tool of claim 12 further comprising at last one aperture provide in a side of the piston rod and leading into the passage in the piston rod.

14. The tool of claim 1 wherein the inner passage running through the tool passes substantially axially through the tool.

15. The tool of claim 1 wherein the setting tool has an upper end, a lower end, and an outer wall.

16. The tool of claim 1 further comprising a centralizer.

17. The tool of claim 1 further comprising a perforating tool, the perforating tool positioned below the top end and above the setting tool.

18. The tool of claim 17 wherein the perforating tool comprises: a body; an inner passage; a sleeve valve and at least one outlet.

19. The tool of claim 18 wherein the perforating tool is configured to be moved between an unset position with the sleeve valve covering the outlets and a set position by running a ball into the tool to shift the sleeve valve downwards, uncovering the at least one outlet.

* * * * *